United States Patent [19]

White et al.

[11] Patent Number: 4,532,766

[45] Date of Patent: Aug. 6, 1985

[54] STIRLING ENGINE OR HEAT PUMP HAVING AN IMPROVED SEAL

[76] Inventors: Maurice A. White, 2802 S. Everett Pl., Kennewick, Wash. 99337; Peter Riggle, 616 Fuller; Stuart G. Emigh, 67 Park St., both of Richland, Wash. 99352

[21] Appl. No.: 518,527

[22] Filed: Jul. 29, 1983

[51] Int. Cl.[3] ..... F02G 1/04

[52] U.S. Cl. ..... 60/517; 60/520; 62/6; 277/3

[58] Field of Search ..... 60/517, 520; 277/3, 277/236; 74/18.2; 62/6

[56] References Cited

U.S. PATENT DOCUMENTS

| | | | |
|---|---|---|---|
| Re. 27,567 | 2/1968 | Baungardner et al. . | |
| 3,559,398 | 2/1971 | Meijer et al. | 60/517 X |
| 3,645,649 | 2/1972 | Beale | 60/517 X |
| 3,822,388 | 7/1974 | Martini et al. . | |
| 3,855,795 | 12/1974 | Noble et al. . | |
| 4,381,648 | 5/1983 | Balas, Jr. | 60/517 |

FOREIGN PATENT DOCUMENTS

| | | | |
|---|---|---|---|
| 13252 | 1/1982 | Japan | 60/517 |
| 2106992 | 4/1983 | United Kingdom | 60/517 |

OTHER PUBLICATIONS

Assessment of the State of Technology of Automotive Stirling Engines—Sep. 1979—DOE/NASA/00-32-79/4.

Dynamic High-Pressure Seals in Stirling Engines, 8th International Conference on Fluid Sealing, Sep. 11-13, 1978 by G. Theeuwes.

Dynamic Seals in Stirling Engines, Highway Vehicle Systems Contractors Coordination Meeting, Apr. 24-26, 1979, by G. J. A. Theeuwes.

National Heart and Lung Institute Report No. N01-H-B-4-2901-3, Aug. 1976, Johnston, R. P., et al "Implanted Energy Convertion System".

IECEC '1975 Record, pp. 1448-1455, Johnston, R. P. et al., "A Stirling Engine with Hydraulic Power Output for Powering Artificial Hearts" (Paper No. 759212).

IECEC Proceedings, vol. 1, Sep. 12-27, 1976, Johnston, R. P. et al., "A Stirling/Hydraulic Power Source for Artificial Hearts".

IECEC Proceedings, Aug. 28-Sep. 2, 1977, R. P. Johnston et al. "Stirling Hydraulic Artificial Heart Power Source".

IECEC Proceedings, Aug. 20-25, 1978, R. P. Johnston et al., "Miniature Long-Life Stirling Engine to Power an Artificial Heart.

IECEC Proceedings, Aug. 5-10, 1979, R. P. Johnston, et al., "Miniaturized Stirling Engine for Artificial Heart Power" (Paper No. 799247).

*Primary Examiner*—Stephen F. Husar

*Attorney, Agent, or Firm*—Wells, St. John & Roberts

[57] ABSTRACT

A Stirling Engine or Heat Pump having two relatively movable machine elements for power transmission purposes includes a hermetic seal bellows interposed between the elements for separating a working gas from a pressure compensating liquid that balances pressure across the bellows to reduce bellows stress and to assure long bellows life. The volume of pressure compensating liquid displaced due to relative movement between the machine elements is minimized by enclosing the compensating liquid within a region exposed to portions of both machine elements at one axial end of a slidable interface presented between them by a clearance seal having an effective diameter of the seal bellows. Pressure equalization across the bellows is achieved by a separate hermetically sealed compensator including a movable enclosed bellows. The interior of the compensator bellows is in communication with one side of the seal bellows, and its exterior is in communication with the remaining side of the seal bellows. A buffer gas or additional liquid region can be provided at the remaining axial end of the clearnace seal, along with valved arrangements for makeup of liquid leakage through the clearance seal.

8 Claims, 6 Drawing Figures

STIRLING ENGINE OR HEAT PUMP HAVING AN IMPROVED SEAL

FIELD OF THE INVENTION

This invention relates to Stirling Engines or Heat Pumps in which it is necessary or desirable to hermetically seal one fluid from another, particularly a gas from a liquid, in such a manner that power may be transmitted across the seal interface by cyclic pressure-volume work and/or by a reciprocating rod.

BACKGROUND OF THE INVENTION

Stirling Engines offer exceptional advantages of multifuel (including solar) capabilities, very low emissions with hydrocarbon fuels, exceptionally high thermodynamic efficiency, and the potential for very long low-maintenance operation. The major technical reason that these advantages have not been commercially realized is that available means for sealing the necessary pistons and rods (except at very low power levels) are unreliable and compromise performance and/or lifetime. The present invention offers a unique pressure balanced sealing mechanism which addresses all the technical problems with existing seals, is appropriate for all power levels of interest, and has the potential for cost effective implementation.

Rod seals and piston seals in a Stirling Engine typically consist of single or multiple sliding or scraping seals which are intended to allow cyclic volume change of the gaseous working fluid or to transmit mechanical power through a rod to a load while preventing egress of the gas or ingress of oil or oil vapor to the gaseous working fluid. The basic problem with such non-hermetic seals for long-life requirements in such machinery is that they cannot totally prevent loss of working fluid. Even more importantly, ingress of oil vapor to the engine working fluid contaminates heat transfer surfaces. Sliding seals also impose substantial friction losses. Use of water as a lubricant in Stirling Engine applications has been suggested, but this requires use of air rather than helium or hydrogen for the engine working fluid, which materially compromises engine performance.

An alternate sealing means which utilizes an elastomeric rollsock seal to effect sealing in a Stirling Engine was developed to an advanced state prior to discovery of this invention, but was abandoned because it was complex, expensive, and did not produce consistent lifetime results. The rollsock seal bears a superficial resemblance to the subject of the present invention, but major differences exist which cause the rollsock seal to be commercially impractical. An auxiliary gas space sliding seal must be used to isolate the rollsock seal from engine cyclic pressure variations, and a complex pressure regulator must be used to maintain a substantial static pressure difference across the rollsock seal in a specified direction. Due to its flexible nature, a rollsock seal must be made from elastomeric materials. The gas permeability of such materials limits the degree of sealing attainable with this seal structure. A true hermetic seal cannot be accomplished at the working gas pressures encountered in Stirling applications.

Metal diaphragms have been used as hermetic seals in Stirling machines, but the limited available stroke of a diaphragm make such seals impractical. This is particularly true in larger engines or heat pumps.

Metal bellows have previously been used to provide a hermetically sealed moving interface in small hydraulic output Stirling Engines for an artificial heart power source application. These seals have proven to be cost effective, reliable, long lived, and efficient in that application where power output requirements are limited, and are on the order of five watts. Attempts to scale that technology to the fifteen-kilowatt level showed that hydraulic flow losses were unacceptably high.

The prior bellows seal was applied only to a free-floating piston across one end of a supporting bellows, which is inherently self balancing. No effort was directed to the challenge of sealing a frictional clearance seal along a rod or piston so as to hermetically seal the working gas from liquid lubricants necessary for reciprocation of a power transmitting member so supported.

The sealing approach which is the subject of this disclosure represents the successful conclusion of an effort to retain the advantages of the heart engine bellows seal technology in a seal concept which is practical for high power output engines. Unique and innovative features have been combined to achieve these results.

Briefly, the present invention offers an improved method for sealing the working gas from a lubricating fluid along a clearance seal for a reciprocating working member in a Stirling Engine or Heat Pump. A long life hermetic seal is accomplished by means of one or more metal bellows. A critical feature which makes the bellows seal practical is provision of means for pressure balancing the bellows which maintains essentially equal instantaneous pressures in a gas and a liquid at opposite sides of each bellows used, even though the working gas pressures may vary cyclically over a range of hundreds of pounds per square inch at a rate of thousands of times per minute. The instantaneous pressure history may differ greatly among individual bellows, even when two bellows are used in the same sealing mechanism. Pressure balancing is accomplished by a judicious selection of effective bellows seal diameter relative to the associated rod or piston diameter, coupled with an auxiliary pressure compensator which may also actuate a pilot valve to provide for fluid makeup or overflow as needed to accommodate normal internal fluid leakage within one fluid region. The sealing means are described in various configurations which use either single or double bellows seals depending on availability of external hydraulic makeup fluid and which can function as either rod seals or piston seals for either kinematic or free-piston or hybrid (e.g., Ringbom) Stirling Engines or Heat Pumps.

BRIEF DESCRIPTION OF THE DRAWINGS

Several embodiments of this invention are illustrated in the accompanying drawings, in which.

DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 6:
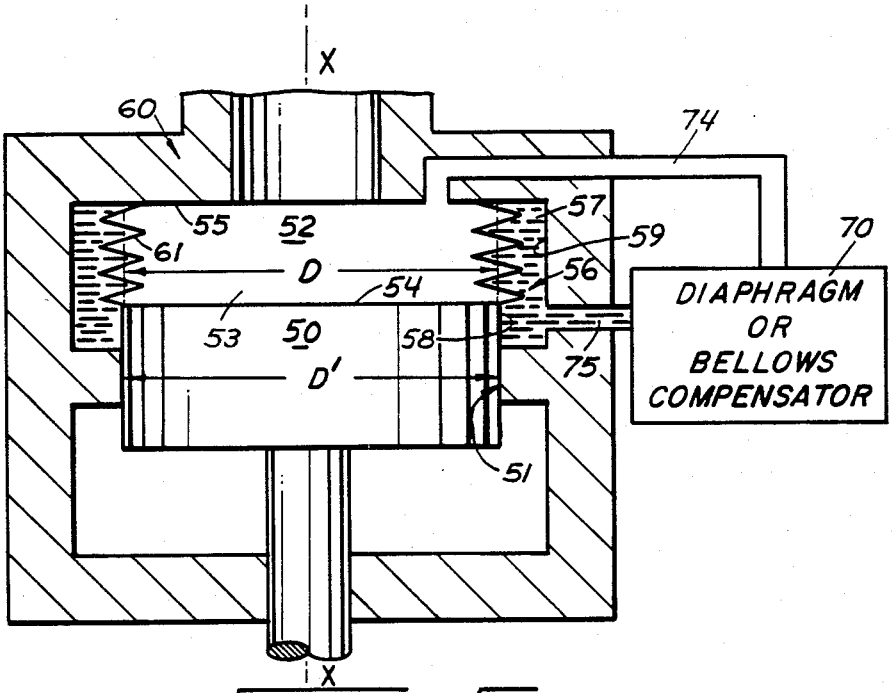
FIG. 6 is a simplified diagrammatic view illustrating the basic features of the invention.

The present improvement in a Stirling Engine or Heat Pump provides hermetic sealing between two relatively movable machine elements to positively separate a working gas and a lubricating liquid. The improvement in its broad aspect is illustrated in FIG. 6. It includes a first machine element 50 centered along a machine axis X—X and a second machine element 60 coaxially arranged along the same axis. A clearance seal at 51 forms a slidable cylindrical interface between complementary surfaces of the first and second machine elements 50, 60 to accommodate reciprocating movement of one machine element relative to the other along the axis for power transmission purposes. In a typical installation, the respective machine elements will include the housing and one or more working members involved in power transmission functions, such as a reciprocating piston and the housing; the housing and a connecting rod; or a piston and a coaxial independently movable rod. These variations are expressly illustrated in the several specific Stirling Engine embodiments described in detail below.

A first fluid region 52 is filled with a pressurized fluid 53 (working gas) exposed to portions of both the first and second machine elements about surfaces 54 and 55, respectively. A second fluid region 56 is similarly filled with a relatively incompressible pressurized fluid 57 (lubricating liquid) exposed to other portions of both the first and second machine elements about surfaces 58 and 59, respectively, and extends to one axial end of the slidable interface formed between them by clearance seal 51. The liquid serving as the second fluid hydrostatically balances and supports one side of a metal seal bellows 61. Pressure balancing of the bellows reduces the stresses to which it is subjected and results in longer bellows life. It also lubricates clearance seal 51. Bellows 61 is a metal bellows attached to both the first and second machine elements 50, 60 for hermetically separating the fluids 53 and 57 within the first and second fluid regions 52 and 56 while permitting relative reciprocating movement between the first and second machine elements 50 and 60.

Hermetically sealed compensator means 70 can be integral with the engine or heat pump, or can be a separate auxiliary unit. To assure that a hermetic seal is provided between the two fluid regions in communication with it, the compensator means will basically comprise a sealed enclosure surrounding a metal bellows, as shown in the illustrations of the specific embodiments in FIGS. 1–4, or a metal diaphragm. One side of the bellows or diaphragm is in open communication with the first fluid region 52 through passage 74. The remaining side of the bellows or diaphragm is in open communication with the second fluid region 56 through passage 75.

With this arrangement, the pressures of the gas and liquid across the bellows 61 are always maintained in balance so long as the physical limits of movement of the bellows or diaphragm in compensator means 70 are not exceeded. The usual cyclical variations in pressure of the working fluid 53, or relative reciprocation of machine elements 50 and 60 in the engine or pump will cause instantaneous pressure changes in the opposing compensating fluid 57 due to the operation of the compensator 70.

In the preferred embodiments of the invention described in detail below, the metal bellows 61 sealed to the two machine elements 50, 60 preferably comprises an axially expandable cylindrical bellows arranged coaxially between them. The nominal effective diameter of the cylindrical bellows 61 (shown at D in FIG. 6) is substantially equal to the diameter of the slidable cylindrical interface formed between the first and second machine elements by the clearance seal (shown at D′ in FIG. 6). As a result, the volume of the second fluid region 56 will therefore be substantially constant regardless of the instantaneous axial position of one element relative to the other. This constant volume feature minimizes flow of fluid to or from the second fluid region 56, and facilitates instantaneous change of fluid pressure within it by action of the pressure compensator means 70.

As used herein, the term "nominal effective diameter" with respect to the described bellows shall indicate the average diameter between the minimum and maximum bellows diameters. It is illustrated at D in FIG. 6.

The term "effective diameter" with respect to the machine working member shall refer to its diameter along a supporting clearance seal by which it is movably supported for relative reciprocating movement.

As used herein, the term "slidable cylindrical interface" applied to the description of a clearance seal between two relatively movable machine elements shall include simple frictional cylindrical seals or bushings, interposed cylindrical sealing rings, or other sealing arrangements for essentially preventing passage of fluid in an axial direction across two relatively movable machine elements. It is illustrated schematically at 51 in FIG. 6.

Figure 1:
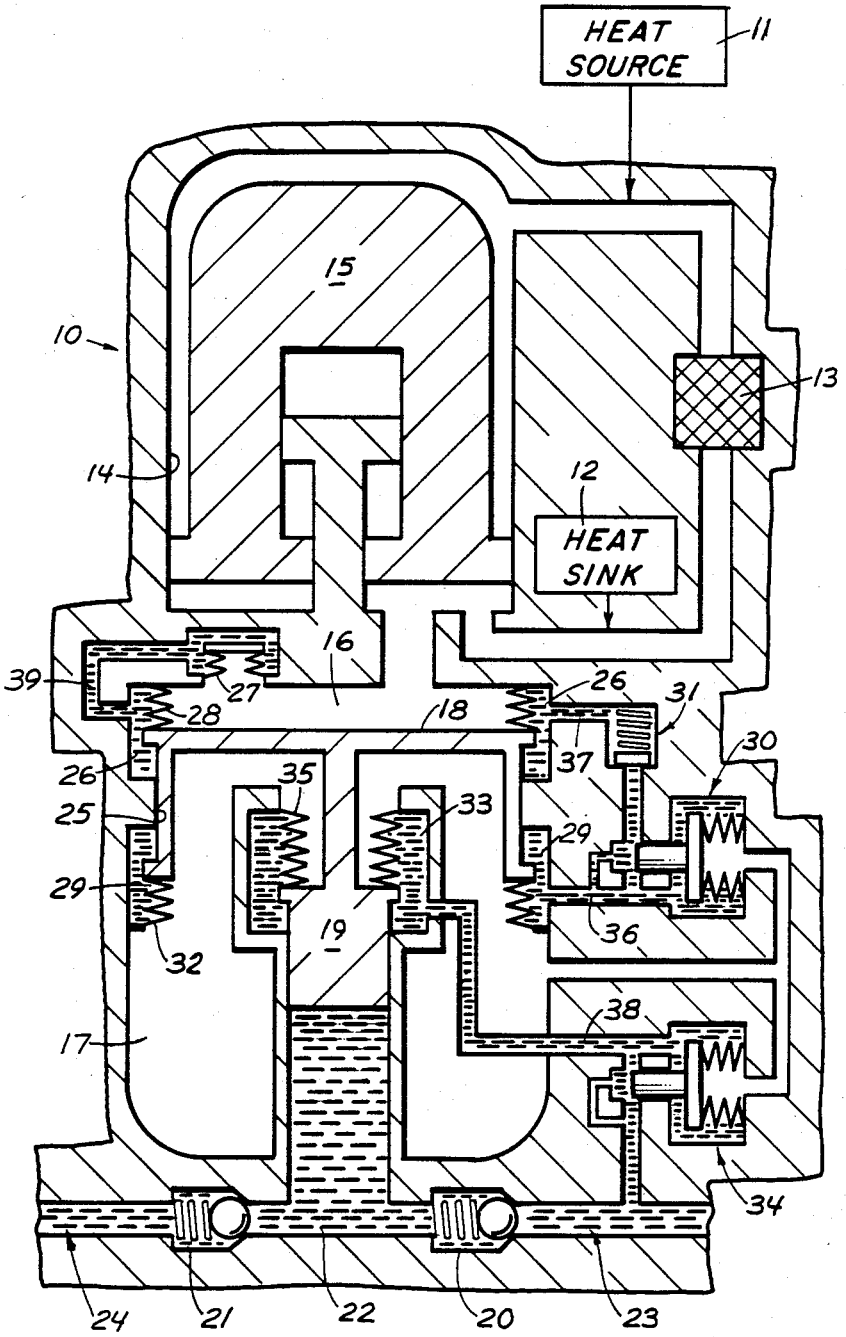
FIG. 1 is a simplified sectional elevation view of the sealing mechanism in a free-piston hydraulic output Stirling Engine.

In the embodiment of the present invention illustrated in FIG. 1, apparatus 10 operates as a heat engine using the basic Stirling cycle. The working fluid is a gas. The apparatus includes a heat source 11, a heat sink 12, a regenerator 13, and a displacer cylinder 14. The displacer 15 is mounted for reciprocation within the displacer cylinder which produces pressure variations in the working gas 16. The working gas is typically hydrogen or helium, but may be air or some other gas chosen for favorable characteristics.

The working gas 16 is separated from a buffer gas 17 by a power piston 18. Work done on the power piston 18 by the working gas 16 is transferred to an integral hydraulic pump piston 19 which works in conjunction with check valves 20 and 21 to pump hydraulic fluid 22 from a low-pressure zone 23 to a high-pressure zone 24.

According to the improvement, a hermetic seal is provided between power piston 18 and the engine housing, thereby separating the working gas 16 from the hydraulic fluids necessary for lubrication purposes. This seal is effected by a coaxial bellows 28. The ends of seal bellows 28 are fixed respectively to the upper surface of piston 18 and an opposed surface of the engine housing.

Hydraulic fluid 26 in a clearance seal 25 provided between piston 18 and the engine housing serves to lubricate the power piston 18. Hydraulic fluid 26 is maintained at pressures essentially equal to the working gas instantaneous pressure by a compensator bellows 27. Therefore seal bellows 28 is pressure balanced.

Similarly, the lower end of power piston 18 is hermetically sealed by a bellows 32 fixed between it and an adjacent cylindrical surface of the engine housing. It separates the buffer gas 17 and the hydraulic fluid 29 that lubricates clearance seal 25.

Hydraulic fluid 29 within the fluid region defined by seal bellows 32 is maintained very near buffer gas instantaneous pressure by the bellows of a compensator valve 30. Therefore seal bellows 32 is pressure balanced.

A third seal is provided on power piston 18 at the upper end of its hydraulic pump piston 19. This is also shown as a coaxial bellows 35 sealed to an annular surface about the movable piston 19 and to a displaced fixed annular surface on the engine housing. It prevents intermixing of buffer gas 17 and the hydraulic fluid 22 worked upon by the lower end of pump piston 19.

Hydraulic fluid 33 that surrounds seal bellows 35 is maintained very near the instantaneous pressure of the buffer gas by the bellows of compensator valve 34. Therefore, seal bellows 35 is pressure balanced.

Pressure balancing of the three seal bellows as discussed above results in low bellows stresses and long bellows life.

The displaced volume of hydraulic fluid 26 and 29 is nearly zero because the nominal effective diameters of seal bellows 28 and 32 match the nominal outside diameter of the power piston 18 at clearance seal 25. Similarly, the displaced volume of hydraulic fluid 33 is low because the nominal effective diameter of seal bellows 35 matches the effective diameter of hydraulic pump piston 19. Minor displaced volumes of hydraulic fluids 26, 29, and 33 are accommodated by compensator bellows 27, the bellows of compensator valve 30, and the bellows of compensator valve 34, respectively. Hydraulic flow power losses are low because pressure drops in compensation lines 36, 37, 38 and 39 are low and because bellows convolution pressure drops are low.

The time-average pressure of hydraulic fluid 22 exceeds the time-average pressure of hydraulic fluid 33 (maintained essentially equal to buffer gas 17 time-average pressure by compensator valve 34) in the example of FIG. 1. Therefore leakage past the clearance seal of pumping piston 19 occurs from hydraulic fluid 22 to hydraulic fluid 33. This small leakage is bled off by compensator valve 34 to low-pressure zone 23. The time-average pressure of hydraulic fluid 26 (maintained essentially equal to working gas 16 time-average pressure by compensator bellows 27) exceeds the time-average pressure of hydraulic fluid 29 (maintained essentially equal to buffer gas 17 time-average pressure by the bellows of compensator valve 30). Therefore leakage occurs from hydraulic fluid 26 to hydraulic fluid 29 past clearance seal 25 of power piston 18. This leakage is returned to hydraulic fluid 26 by compensator valve 30 during portions of the engine cycle when working gas pressure 16 is below buffer pressure 17. Check valve 31 prevents reverse flow through compensator valve 30.

Referring now to the broad discussion of the invention which preceded the details of FIG. 1, the application of the principles of the invention as they apply to seal bellows 28 will be related to the general discussion of FIG. 6. A similar relationship of machine elements will be evident as to seal bellows 32 and 35, as well as each of the remaining seal bellows of the further embodiments.

The displacer cylinder 14, which is a portion of the block or engine housing, serves as the previously-described "first machine element". The power piston 18 serves as the "second machine element". The clearance seal 25 forms a slidable cylindrical interface between them which has a diameter substantially equal to the nominal effective diameter of bellows 28.

The first fluid region, containing the pressurized working gas 16, is exposed to portions of both the engine housing and power piston 18, as well as to the inner surfaces of the bellows 28. The second fluid region, filled with the pressurized hydraulic fluid 26, is exposed to remaining portions of both the engine housing and the power piston 18 at the upper axial end of the slidable interface between them by clearance seal 25.

The bellows 28 separates the two fluids 16 and 26 while permitting relative reciprocating movement of the power piston 18 relative to the engine housing. Bellows 27 serves as the "compensator means". One side of bellows 27 (its interior) is in open communication with the working fluid 16 and its remaining side (its exterior) is in open communication with the hydraulic fluid 26. In this manner, the pressures of the two fluids 16 and 26 are maintained essentially equal as bellows 27 axially expands or contracts due to very small pressure differences across its closed end. This maintains essentially equal pressure radially across the walls of seal bellows 28.

Figure 2:
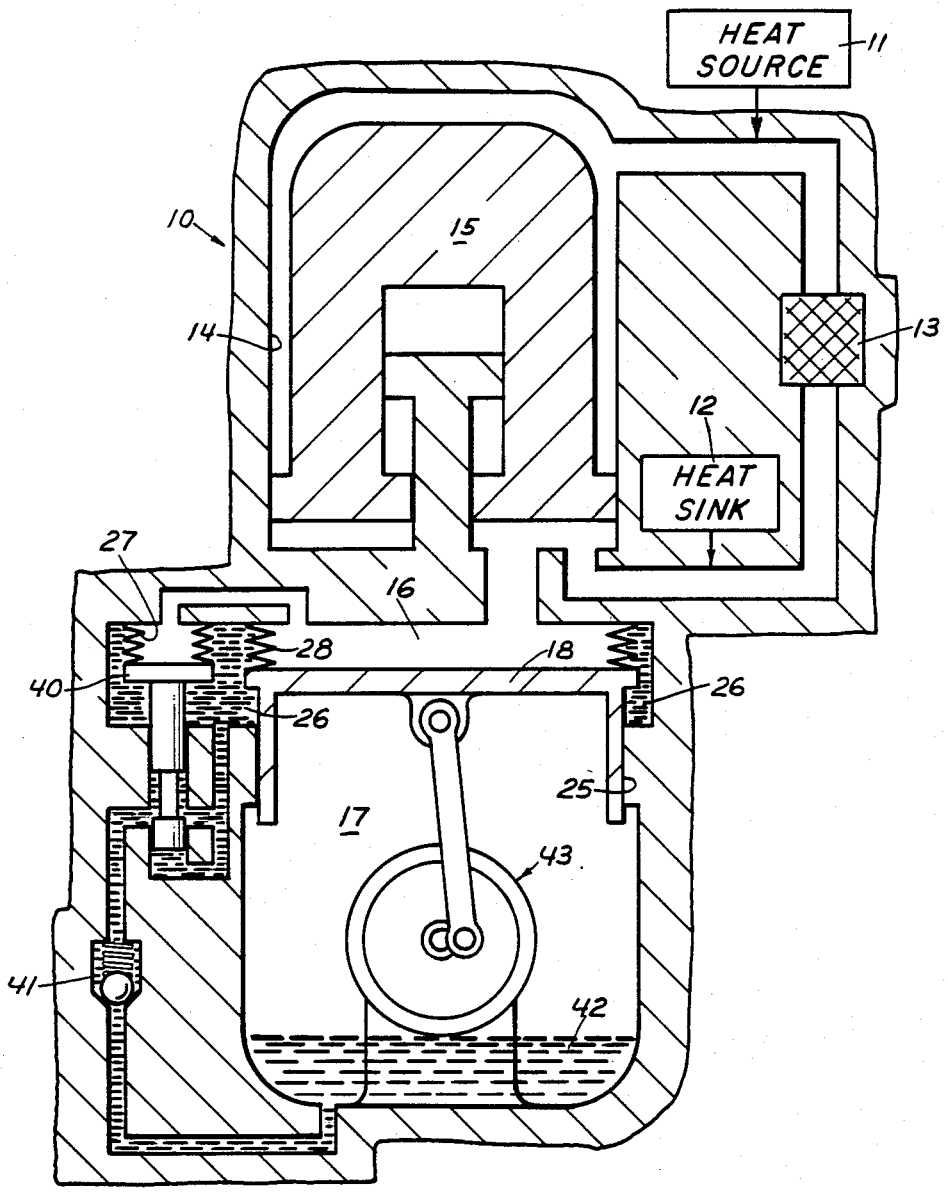
FIG. 2 is a simplified sectional elevation view of the sealing mechanism in a Ringbom hybrid Stirling Engine.

An embodiment of an alternative form of the present invention as illustrated in FIG. 1 is shown in FIG. 2. Similar reference numbers are used to designate corresponding machine elements in these two views. The power piston seal is similar to that of FIG. 1 but uses one less seal bellows and one less compensator bellows. A crank driven rotary load 43 is used in the embodiment of FIG. 2 to demonstrate the generality of the present invention with respect to the applied load. Pressure in hydraulic fluid 26 is maintained very close to the pressure of working gas 16 by the bellows 27 of compensator valve 40. Therefore, seal bellows 28 is pressure balanced for low stress and long life. Leakage flows from hydraulic fluid 26 to buffer gas 17 through clearance seal 25 and accumulates in the sump 42. The leakage is returned to hydraulic fluid 26 through compensator valve 40 during portions of the engine cycle when working gas pressure is below buffer gas pressure. Check valve 41 prevents backflow through compensator valve 40.

The leakage makeup system shown in FIG. 2 is practical for designs in which the buffer gas 17 time-average pressure is below the working gas 16 time-average pressure and the working gas instantaneous pressure dips below the buffer instantaneous pressure once per engine cycle. In cases where the working gas instantaneous pressure fails to dip below the buffer instantaneous pressure once per cycle, check valve 41 can be replaced by an oil pump.

Figure 3:
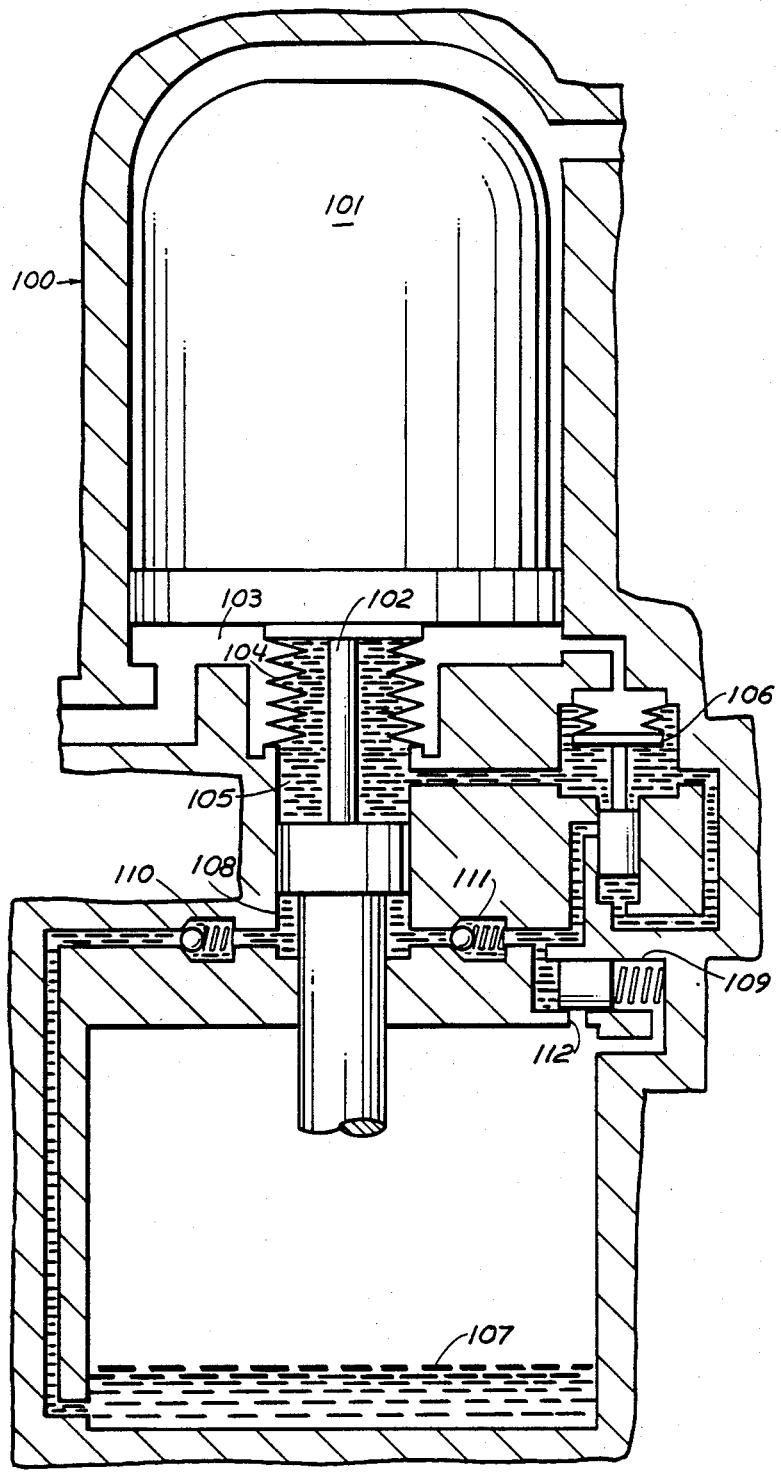
FIG. 3 is a simplified sectional elevation of the sealing mechanism as used in a rod seal application.
Figure 4:
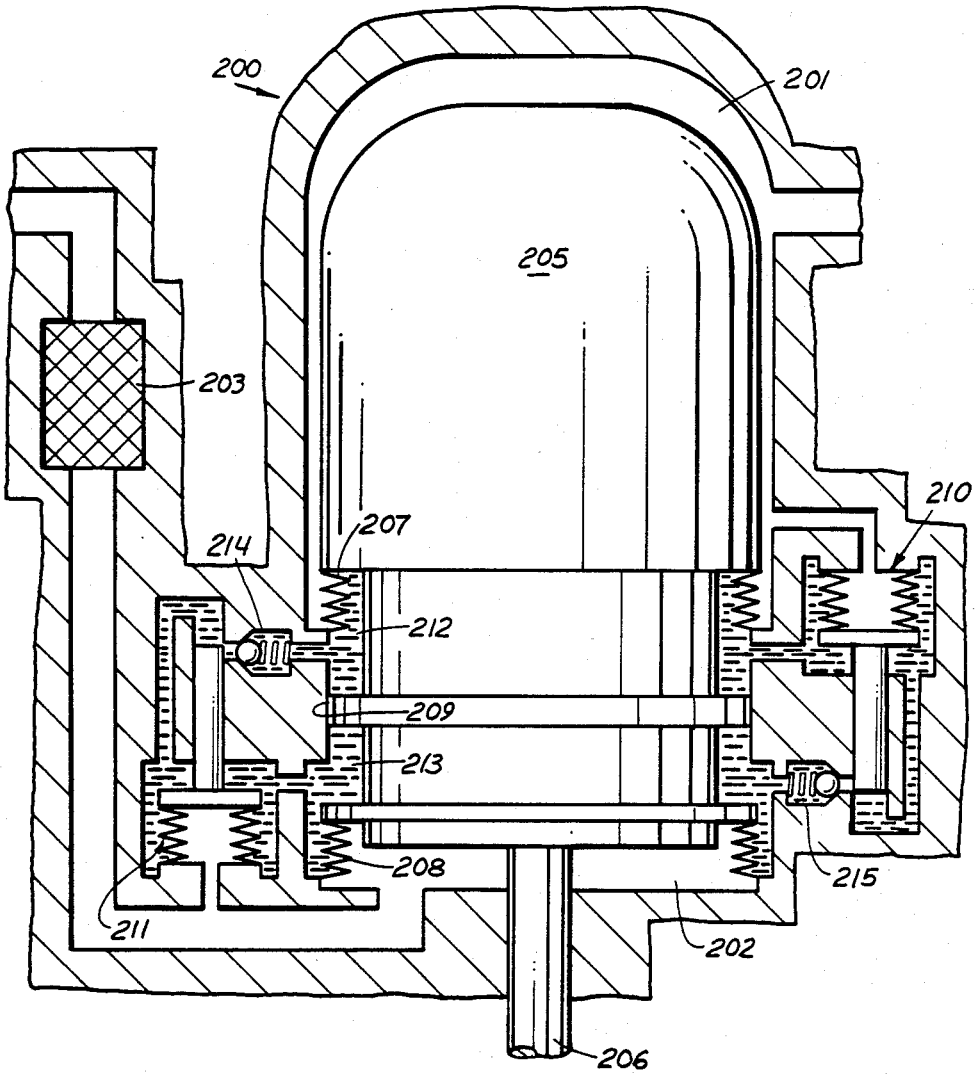
FIG. 4 is a simplified sectional elevation view of the sealing mechanism as used in a piston seal application.
Figure 5:
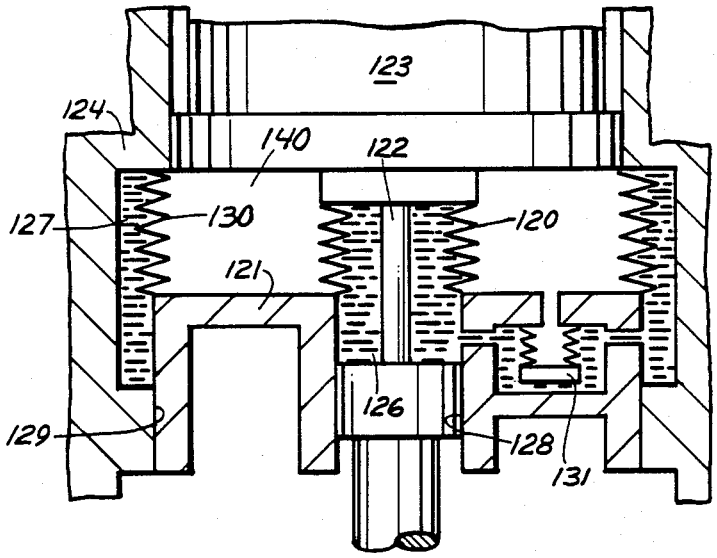
FIG. 5 is a simplified sectional elevation view showing a combination of both a rod seal application and a piston seal application.

In the embodiment of the present invention illustrated in FIG. 3, apparatus 100 operates as one cycle of a Siemens connected double acting hot gas heat engine. The piston 101 is driven by piston rod 102 which is sealed from working gas 103 by a seal bellows 104. The pressure of hydraulic fluid 105 is maintained equal to the instantaneous working gas pressure by the bellows of a compensator valve 106. As in other embodiments of the present invention, pressure balancing of the seal bellows 104 greatly reduces bellows stress and extends bellows life.

In this embodiment, the time-average of the working gas pressure exceeds the time-average pressure of the sump 107, and exceeds the time-average pressure of the oil pumping region 108. Therefore leakage occurs from 2. The Stirling cycle engine or heat pump of claim 1, further comprising:

a third fluid region at the remaining axial end of said slidable interface formed between the first and second machine elements by said clearance seal means.

3. The Stirling cycle engine or heat pump of claim 1, further comprising:

a third fluid region at the remaining axial end of said slidable interface formed between the first and second machine elements by said clearance seal means;

said third fluid region being filled with liquid identical to that within the second fluid region.

4. The Stirling cycle engine or heat pump of claim 1, further comprising:

a third fluid region at the remaining axial end of said slidable interface formed between the first and second machine elements by said clearance seal means;

said third fluid region being filled with liquid identical to that within the second fluid region;

and means in communication with both the second and third fluid regions for transferring liquid between them to compensate for leakage through the clearance seal means.

5. The Stirling cycle engine or heat pump of claim 1, further comprising:

a third fluid region at the remaining axial end of said slidable interface formed between the first and second machine elements by said clearance seal means;

said third fluid region being filled with a buffer gas.

6. The Stirling engine or heat pump of claim 1 wherein the first machine element comprises a stationary housing;

said second machine element comprising a working member movably mounted by the housing for reciprocable motion along said axis for power transmission purposes.

7. The Stirling cycle engine or heat pump of claim 6 wherein the working member is a piston.

8. The Stirling cycle engine or heat pump of claim 6 wherein the working member is a reciprocating rod.

* * * * *